United States Patent [19]

Tran et al.

[11] 4,063,125

[45] Dec. 13, 1977

[54] HIGH-FREQUENCY FOCUSING DEVICE FOR FOCUSING A BEAM OF CHARGED PARTICLES ACCELERATED WITHIN A CYCLOTRON

[75] Inventors: Duc Tien Tran; Jacques Kervizic; Bernard Hurt, all of Paris, France

[73] Assignee: C.G.R.-MeV, Paris, France

[21] Appl. No.: 700,156

[22] Filed: June 28, 1976

[30] Foreign Application Priority Data

July 1, 1975 France ..... 75.20647

[51] Int. Cl.[2] ..... H05H 13/00

[52] U.S. Cl. ..... 313/62

[58] Field of Search ..... 313/62; 328/234

[56] References Cited

U.S. PATENT DOCUMENTS 2,454,094 11/1948 Rosenthal ..... 313/62 X

*Primary Examiner*—Palmer C. Demeo

*Attorney, Agent, or Firm*—Oblon, Fisher, Spivak, McClelland & Maier

[57] ABSTRACT

A high-frequency focusing device making it possible to achieve suitable horizontal and vertical focusing of a beam of charged particles issued from a particle source located substantially at the center of a cyclotron, this device comprising pairs of focusing electrodes fixed to the edges of parallel plates forming each sector-shaped Dees of the cyclotron, each pair of electrodes being arranged in such a manner that the particle beam passes between them, these electrodes which project into the acceleration space *e* of the cyclotron, making it possible to compensate for lack or excessive vertical focusing brought about by the magnetic field developed in the acceleration space *e*.

7 Claims, 12 Drawing Figures

$\emptyset = wt$ $\Delta\emptyset = h\,\Delta\theta$

HIGH-FREQUENCY FOCUSING DEVICE FOR FOCUSING A BEAM OF CHARGED PARTICLES ACCELERATED WITHIN A CYCLOTRON

In accelerators of the cyclotron kind (cyclotrons or synchrocyclotrons), the beam of charged particles emitted by a particle source located at the centre of these accelerator, is subjected to the horizontal and vertical components of the high frequency electric field developed between the accelerating electrodes, or "Dee's" of the accelerator, the vertical component of the H.F. electric field successively having a focusing and defocusing effect upon the beam depending upon the phase of the H.F. electric field when the particles enter it.

Focusing in the vertical plane, at the level of the source, is generally produced by a "hump" in the isochronous magnetic field in the neighborhood of the source, but the magnetic field gradient thus obtained still acts in the same manner upon the particle beam whatever the phase of the H.F. electric field at the instant at which it penetrates the latter. The result is that for a given phase on the part of the H.F. electric field, the particle beam defocused by said field is more or less re-focused by the magnetic field whereas for a different phase on the part of the H.F. electric field, the beam focused by the latter is also focused by the magnetic field, in which case the particles may strike the walls of the accelerator, this being due to excessive focusing, with a consequent diminution in the effective "phase zone", either as a consequence of lack of focusing or of excessive focusing.

Lack of focusing or "over-focusing", is the more prejudicial to the proper operation of the accelerator the lower the energy of the particles, and this is the case in the neighbourhood of the source.

The microwave focusing device which forms the object of the present invention makes it possible to appropriately modify the focusing and de-focusing effect, in the vertical plane, of the H.F. electric field on the particle beam in the neighbourhood of the particle source.

In accordance with the invention, a high-frequency focusing device for a beam of charged particles accelerated in a cyclotron type accelerator, said accelerator comprising a particle source, at least two electrodes or "Dee's" provided with two plates parallel to the plane of the trajectory of said beam and arranged between the polepieces of an electromagnet creating a predetermined magnetic field, means making it possbile to create a high-frequency electric field between said electrodes, said high-frequency focusing device comprising at least one pair of metal focusing electrodes attached to one of the "Dee's" in the neighbourhood of said source, said focusing electrodes protruding into the accelerator space defined between the "Dee's", said focusing electrodes being arranged in such a fashion that they are disposed to either side of one of the approximately circular trajectories followed by the particle beam during the course of one of it's first revolutions.

For a better understanding of the invention and to show how the same may be carried into effect, reference will be made to the drawings accompanying ensuing description in which:

FIG. 1 illustrates in simiplified form the two accelerating electrodes $D_1$ and $D_2$ or "Dee's" of a cyclotron, and two pairs of focusing electrodes 1, 2 and 3, 4 respectively attached to the "Dee's" $D_1$ and $D_2$.

Figure 1:
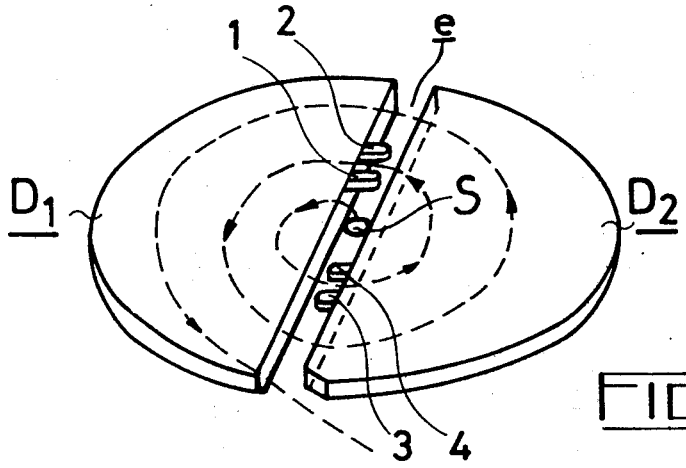
FIG. 1 illustrates a cyclotron with two "Dee's" equipped with a focusing device in accordance with the invention.
Figure 2:
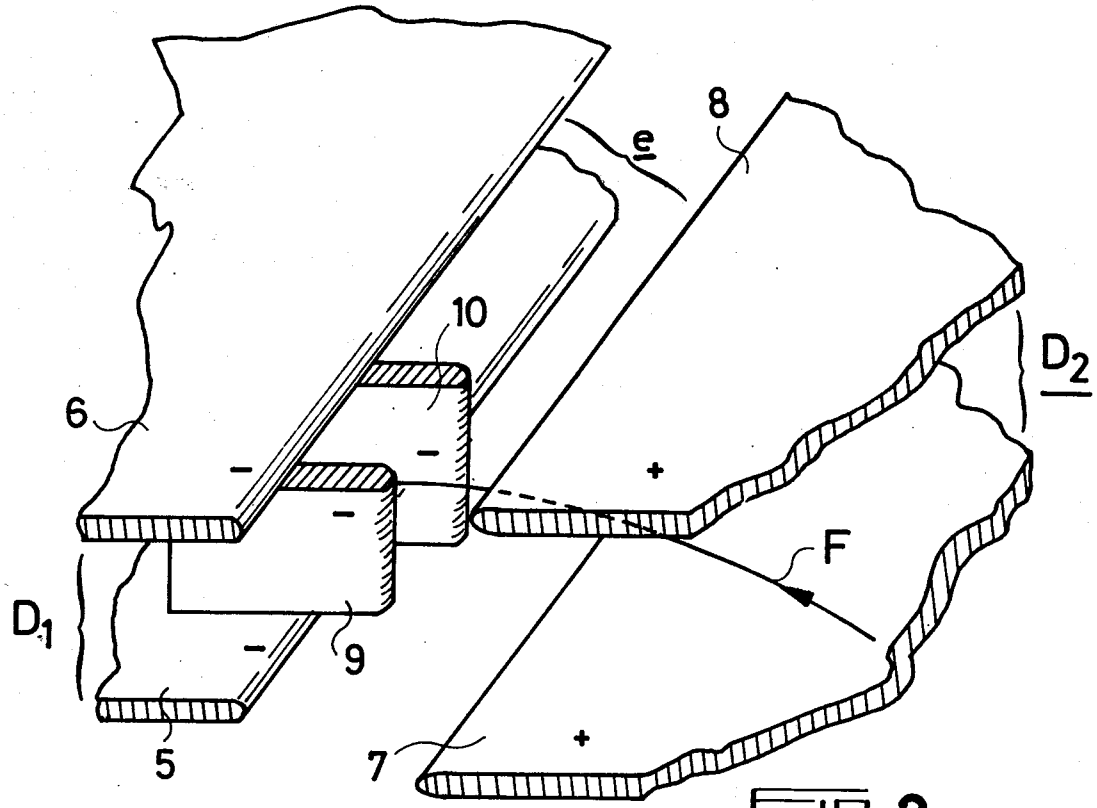
FIG. 2 illustrates a detail of an embodiment of a focusing device in accordance wiht the invention.

FIG. 2, which illustrates a detal of FIG. 1, provides a better understanding of an embodiment of a focusing device in accordance with the invention, and of how it operates.

The "Dee's" $D_1$ and $D_2$ respectively comprise two plates 5, 6, 7 and 8 between which the spiral trajectory of a beam F of charged particles coming from a source S (FIG. 1) loccated at the centre of the cyclotron, passes. To the plates 5, 6 of the "Dee" $D_1$ and the plates 7, 8 of the "Dee" $D_2$ there is applied a high-frequency voltage which creates between the "Dee's" $D_1$ and $D_2$, in the acceleration space *e*, a H.F. electric field designed to accelerate the beam F each time it passes through the accelerating slot *e*. Metal focusing electrodes 9 and 10 are arranged between the plates 5, 6 and the "Dee" $D_1$ and therefore carry the same H.F. potential as these latter. These focusing electrodes 9 and 10 are arranged in such a fashion that the trajectory of the beam F passes between the two electrodes 9 and 10.

The + and − signs indicated on the plates 5, 6, 7 and 8 as well as on the focusing electrodes 9 and 10 correspond with the accelerating alternation in the H.F. electric field for a positively charged particle.

Figure 3:
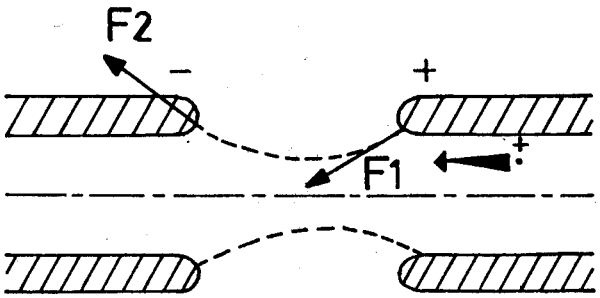
FIGS. 3 and 4 illustrate the forces acting upon the particle beam in the absence of the focusing electrodes, and with focusing electrodes erected in the accelerator space.
Figure 4:
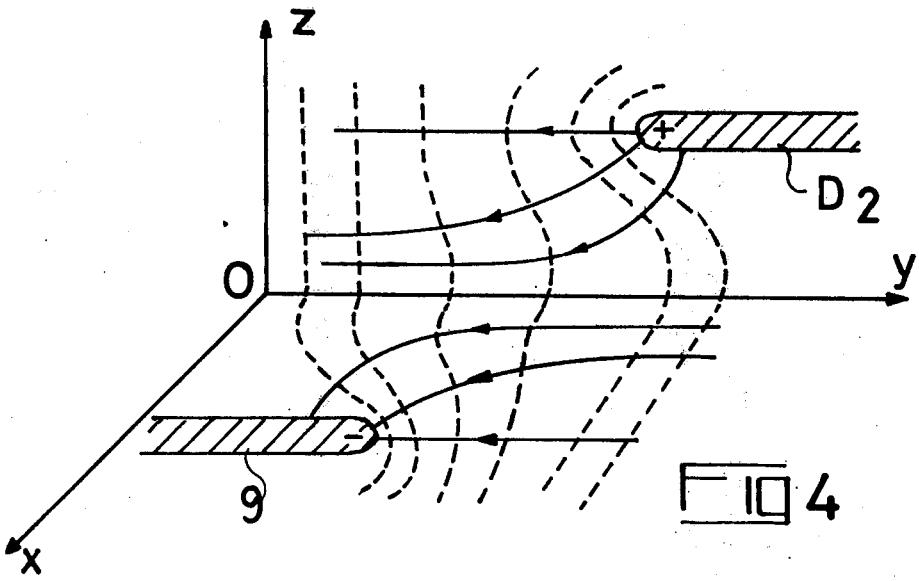

In the absence of focusing electrodes 9 and 10, the H.F. electric field has the direction shown in FIG. 3, creating at the input to the acceleration space *e* a force $F_1$ tending to return the particle to a central plane $P_m$, whilst a force $F_2$ tends to move the particle away from said plane $P_m$ at the output of the acceleration space *e*. If the energy gain acquired by the particle during it's passage through the acceleration space *e* is neglected, then it will be realised that the particle, when located at the centre of the acceleration space *e*, is subjected to a resultant force whose effect is to focus or defocus it depending upon whether or not it is leading or lagging in relation to the peak H.F. electric field at the instant at which it transits the centre of the acceleration space *e*. If one of these two forces $F_1$ or $F_2$ is cancelled, the particle would be subjected solely to the focusing force or to the defocusing force whatever the phase corresponding to transit by the particle. The addition of the focusing electrodes 9 and 10 makes it possible to compensate one of said forces $F_1$ or $F_2$. FIG. 4 illustrates the lines of H.F. equipotential (broken lines) and the distribution of the H.F. electric field (full lines) in the horizontal central plane and in the vertical plane of the acceleration space *e*, this focusing the beam F in the vertical plane and defocusing it in the horizontal plane. The purpose of the focusing electrodes 9 and 10 is to compensate the aforesaid force $F_2$. If the focusing electrodes 9 and 10 were attached to the plates 7 and 8 of the "Dee" $D_2$ then they would compensate the force $F_1$.

The use of suitably positioned focusing electrodes makes it possible to create alternating focusing effects, or focusing in one plane and defocusing in a plane at right angles thereto.

The focusing electrodes can take different forms from that shown in FIG. 2.

Figure 5:
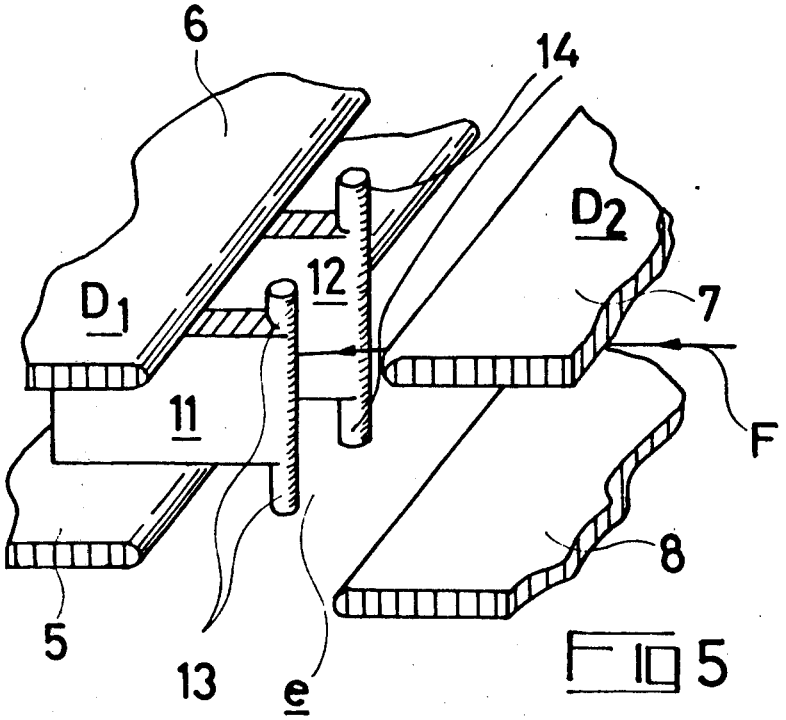
Figure 7:
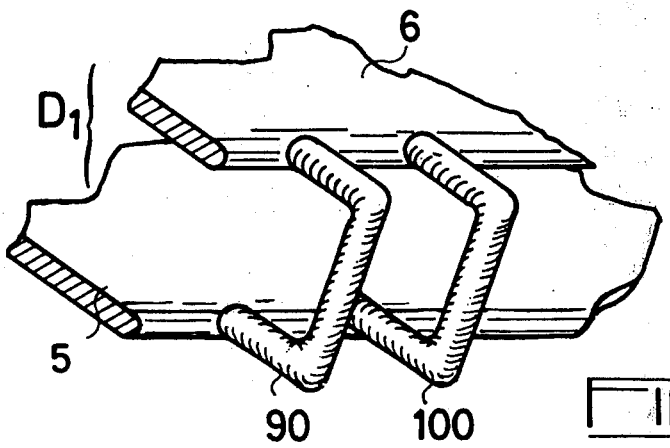

FIGS. 5 and 7 illustrate some examples of electrodes in accordance with the invention.

The focusing electrodes 11 and 12 of FIG. 5 comprising plates arranged perpendicularly to the plane of the trajectory of the beam F are equipped, at that of their ends located in the acceleration space *e*, with bars 13 and 14 respectively overlapping the plates along an axis perpendicular to the plane of the trajectory followed by the beam F, this making it possible to achieve better concentration of the defocusing effect produced in the beam by the H.F. electric field.

Figure 6:
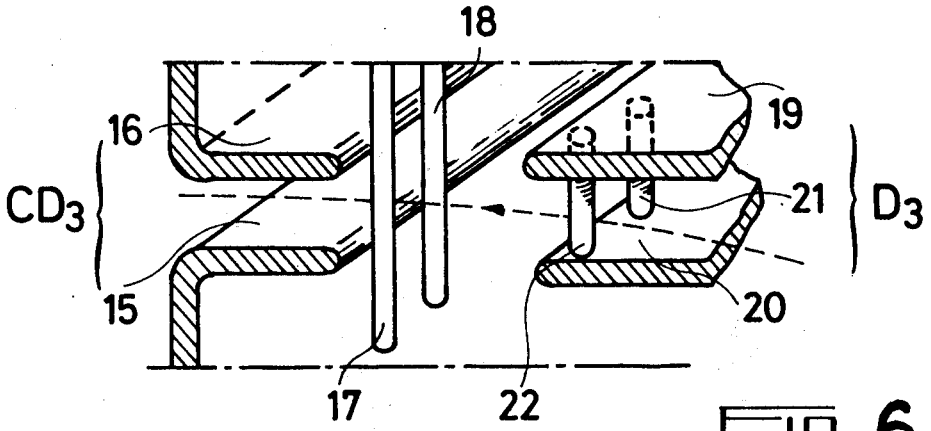

If the accelerating electrodes of the cyclotron are constituted by "Dee's" $D_3$ and "counter-Dee's" $CD_3$, these "counter Dee's" $CD_3$ being earthed, then the focusing electrodes can have the kind of shape shown in FIG. 6. Bars 17 and 18 of cylindrical shape are attached to the "counter-Dee" $CD_3$ at the edge of the plates 15 and 16 and arranged perpendicularly to the plane of the means trajectory of the beam F, and bars 21, 22 are fixed opposite the bars 17 and 18 between the plates 19 and 20 of the "Dee" $D_3$. The bars 21 and 22 fixed to the "Dee" $D_3$ make it possible to reduce the vertical H.F. focusing effect created at the edge of the plates 19 and 20.

In another embodiment shown in FIG. 7, the focusing electrodes 90 and 100, attached to the plates 5 and 6 of the "Dee" $D_1$, are constituted by metal rods bent twice at 90°, whose ends are attached to the plates 5 and 6, these electrodes 90 and 100 projecting into the acceleration space *e* of the cyclotron.

Figure 8:
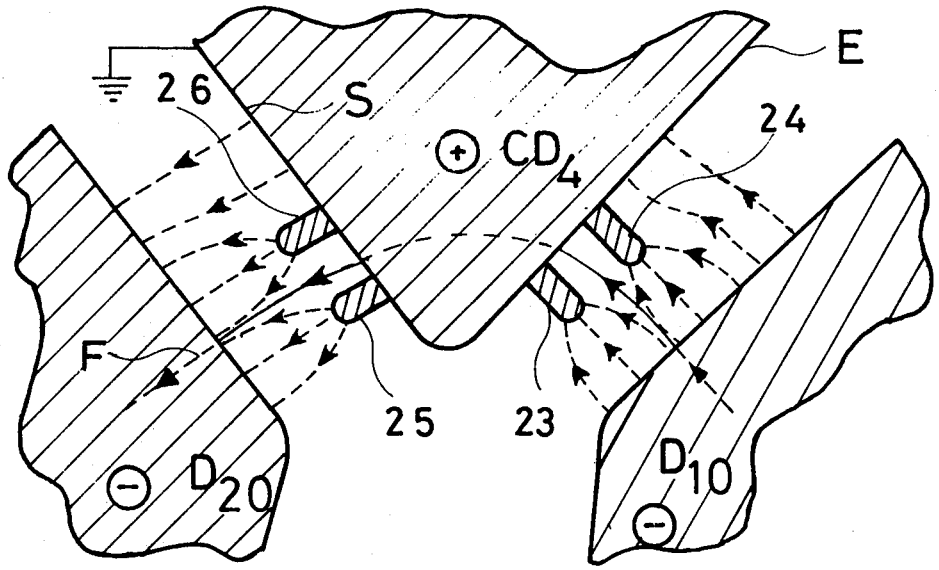
Figure 9:
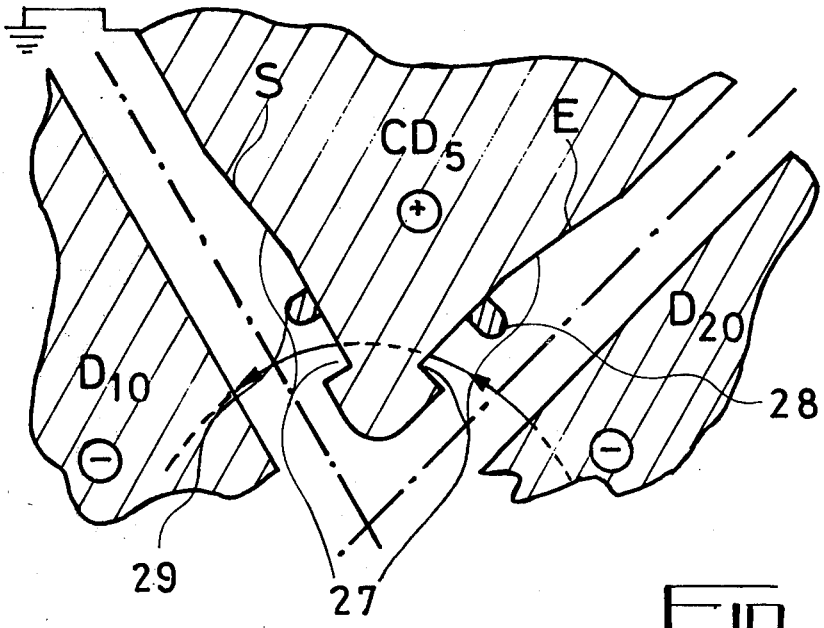

By way of non-limitative examples, FIGS. 8 to 11 illustrate four other embodiments of accelerating electrodes equipped with focusing electrodes in accordance with the invention. In FIG. 8, the "counter-Dee" $CD_4$ is equipped respectively at entry and exit faces E and S for the beam F, with two pairs of focusing electrodes 23, 24, 25 and 26. However, this structure has the effect of varying the electrical angle of the "Dee's" $D_{10}$ and $D_{20}$. The structure shown in FIG. 9 makes it possible to overcome this drawback. The entry E and exit S faces of the "counter-Dee" $CD_5$ have a re-entrant form in the angular zone (the zone situated towards the tip of the sector shaped "counter-Dee" $CD_5$) so that the ends of the focusing electrodes 28 and 29 projecting into the acceleration space *e* are aligned with the edges of the plates constituting the "counter-Dee" $CD_5$ out of the re-entrant zone.

Figure 10:
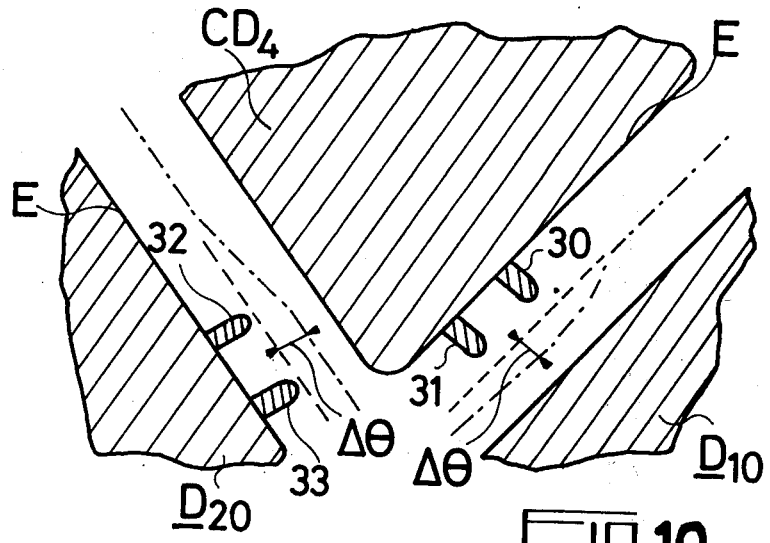

In the example shown in FIG. 10, two focusing electrodes 30 and 31 are arranged on the entry face F of the "counter-Dee" $CD_4$ and two other electrodes 32 and 33 are arranged on the entry face of the "Dee" $D_{20}$. In this case, the electrical angle $\theta$ of the "Dee's" is offset by $\Delta\theta$. If the harmonic used is the harmonic *h*, the phase variation is $h \cdot \Delta\Theta$. This effect can be utilised in order to compensate for the phase shift produced by the "hump" in the magnetic field responsible for the vertical focusing of the beam *f* of charged particles in the acceleration space *e*.

Figure 11:
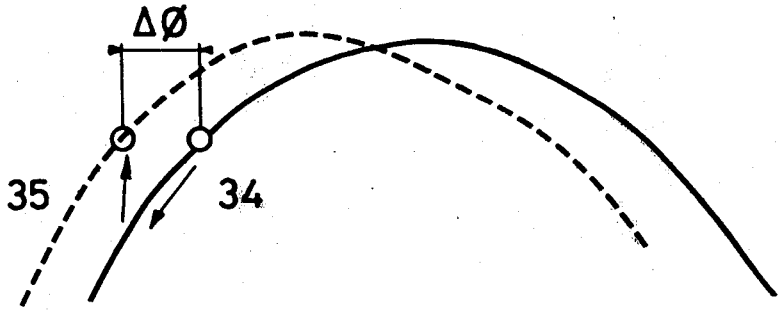
FIGS. 5 to 11 illustrate embodiments of the focusing device in accordance with the invention.

The graph shown in FIG. 11 will provide a better understanding of the compensating effect achieved in relation to this phase shift. The arrow 34 indicates the phase variation due to the "hump" in the magnetic field and the arrow 35 the phase compensation introduced by the variation in the electrical angle of the "Dee's" $D_{10}$ and $D_{20}$.

Figure 12:
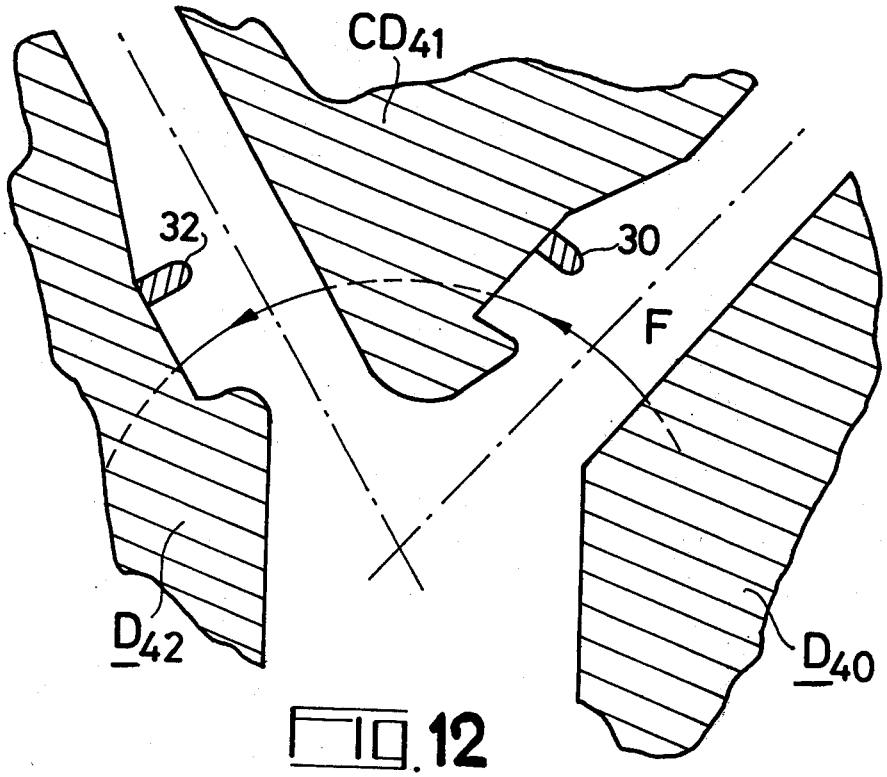
FIG. 12 illustrates a graph plotting the phase variations produced in the particle beam successively by the magnetic field and the focusing electrodes.

The shift $\Delta\theta$ in the electrical angle $\theta$ of the "Dee's" $D_{10}$ and $D_{20}$, (FIG. 10) can be eliminated by giving the accelerator structure a form as shown in FIG. 12 where the "Dee" $D_{42}$ and the "counter-Dee" $CD_{41}$ have a re-entrant form in the angular zone corresponding to the tip of the "Dee" $D_{42}$ and of the "counter-Dee" $CD_{41}$, both of which are substantially sector shaped.

The focusing device in accordance with the invention can advantageously be used in cyclotrons equipped with "Dee's" of lower height or in heavy ion cyclotrons operating at a frequency corresponding to a high-order harmonic. In this case, the phase shift due to the "hump" in the magnetic field is substantial and it is necessary to reduce the "hump" as much as possible. The vertical focusing effect will then be obtained by means of focusing electrodes in accordance with the invention.

What we claim is:

1. A high-frequency focusing device for a beam of charged particles accelerated in an accelerator of cyclotron type, said accelerator comprising a particle source, at least two accelerating electrodes or "Dee's" provided with two plates parallel to the plane of the trajectory followed by said beam and arranged between the pole pieces of an electro-magnet furnishing a magnetic field of a predetermined value, means for creating a high-frequency electric field between said electrodes, said high-frequency focusing device comprising at least one pair of metal focusing electrodes attached to one of the "Dee's" in the neighbourhood of said source, said focusing electrodes projecting into the accelerator space defined between the "Dee's", said focusing electrodes being arranged in such a manner that they are disposed to either side of one of the approximately circular trajectories followed by the particle beam during the course of one of it's first revolutions.

2. A high-frequency focusing device as claimed in claim 1, wherein said focusing electrodes are constituted by metal plates arranged perpendicularly to the plane of the beam path, and located between said plates forming the "Dee" and at the edge of said plates.

3. A high-frequency focusing device as claimed in claim 2, wherein each of said plates comprises an extremity located in the acceleration space, said plate extremities being equipped with bars perpendicular to the plane of said beam path, the length of said bars being greater than the height of said plates which they symmetrically overlap.

4. A high-frequency focusing device as claimed in claim 2, wherein said "Dee's" have a sectoral form, said plates constituting said "Dee's" having a re-entrant form in the angular zone.

5. A high-frequency focusing device as claimed in claim 1, wherein said focusing electrodes are constituted by metal rods bent twice whose two ends are fixed respectively to the two plates of the "Dee's".

6. A high-frequency focusing device as claimed in claim 1, wherein said accelerator comprises two "Dee's" and two "counter-Dee's", two pairs of focusing electrodes being respectively attached to the entry faces of the "Dee's" and "counter-Dee's", successively forming de-focusing and focusing lenses in the plane of said beam path, and focusing and de-focusing lenses in the plane perpendicular to the plane of said beam path.

7. A high-frequency focusing device as claimed in claim 6, wherein the edges of said plates forming said "Dee's" and "counter-Dee's" have a re-entrant zone, said focusing electrode extremities projecting into the accelerating space being aligned with edges of said plates outside the re-entrant zone.

* * * * *